US006640978B2

(12) United States Patent
Reiser et al.

(10) Patent No.: US 6,640,978 B2
(45) Date of Patent: Nov. 4, 2003

(54) SECURABLE HANGER FOR PERSONAL TRANSPORTATION VEHICLES AND ACCESSORIES

(75) Inventors: Richard J. Reiser, Laguna Beach, CA (US); Theodor F. Gillebaard, Laguna Niguel, CA (US)

(73) Assignee: Foot-Pusher's Transit Authority, Inc., Long Beach, CA (US)

( * ) Notice: Subject to any disclaimer, the term of this patent is extended or adjusted under 35 U.S.C. 154(b) by 0 days.

(21) Appl. No.: 09/956,734

(22) Filed: Sep. 11, 2001

(65) Prior Publication Data

US 2002/0060194 A1 May 23, 2002

Related U.S. Application Data

(60) Provisional application No. 60/232,002, filed on Sep. 12, 2000.

(51) Int. Cl.[7] ..... E05B 73/00
(52) U.S. Cl. ..... 211/4; 211/85.7
(58) Field of Search ..... 211/4, 5, 85.2, 211/70.6; D6/552

(56) References Cited

U.S. PATENT DOCUMENTS

| | | | | | |
|---|---|---|---|---|---|
| 2,879,896 | A | | 3/1959 | Green | |
| 3,275,160 | A | | 9/1966 | Zürker | |
| 4,057,983 | A | * | 11/1977 | Morgan | 70/18 |
| 4,155,458 | A | * | 5/1979 | Moline | 211/4 |
| 4,756,504 | A | | 7/1988 | Chamberlain | |
| 5,060,810 | A | | 10/1991 | Jones | |
| 5,076,531 | A | | 12/1991 | Delaney | |
| 5,301,818 | A | | 4/1994 | Dix | |
| 5,675,999 | A | | 10/1997 | Carlstrom | |
| 5,687,701 | A | * | 11/1997 | Henry | 70/18 |
| 5,802,887 | A | | 9/1998 | Beland | |
| 5,887,461 | A | | 3/1999 | Heffley | |
| 5,901,588 | A | * | 5/1999 | Frost | 70/18 |
| 6,044,984 | A | * | 4/2000 | Crosby et al. | 211/4 |
| 6,142,313 | A | | 11/2000 | Young | |
| 6,196,397 | B1 | | 3/2001 | Maher | |
| 6,237,197 | B1 | * | 5/2001 | Donahue | 24/166 |
| 6,293,412 | B1 | * | 9/2001 | Draper | 211/4 |
| 6,481,581 | B2 | * | 11/2002 | Sipe | 211/4 |

* cited by examiner

*Primary Examiner*—Daniel P. Stodola
*Assistant Examiner*—Erica B Harris
(74) *Attorney, Agent, or Firm*—Knobbe Martens Olson & Bear LLP

(57) ABSTRACT

An apparatus for securely storing a folding scooter or skateboard. The apparatus can be mounted on a wall in public places or at home. The apparatus supports the folding scooter or skateboard without exerting clamping pressure on the object held. The apparatus has a mounting plate, a locator plate and a gate that are connected together. The mounting plate secures the apparatus to a mounting structure, the locator plate positions the object to be secured and the gate inhibits removal of the object from the apparatus.

9 Claims, 10 Drawing Sheets

SECURABLE HANGER FOR PERSONAL TRANSPORTATION VEHICLES AND ACCESSORIES

PRIORITY INFORMATION

This application claims priority from Provisional Patent Application No. 60/232,002 filed Sep. 12, 2000, the entire contents of which are incorporated by reference herein.

FIELD OF THE INVENTION

The present invention relates to theft prevention devices. More particularly, the present invention relates to theft prevention devices for folding scooters, skateboards, other personal transportation vehicles and their accessories.

DESCRIPTION OF THE INVENTION

School-aged children frequently use skateboards and, more recently, folding scooters for personal transportation. It is impractical to require students to carry a folding scooter or skateboard from classroom to classroom, most likely in addition to a backpack containing a full day's supply of books. Folding scooters and skateboards also present a safety hazard if not properly stowed. For instance, the scooter or skateboard may be tripped over if left on the floor or underneath desks.

While transportation alternatives to the automobile, such as folding scooters, skateboards and inline skates, have historically been relied upon by children below the driving age, increases in traffic congestion, fuel costs and parking shortages, combined with an increased concern over environmental problems linked to motorized vehicles, have resulted in an increased use of these vehicles by older children and adults. The generally compact nature of folding scooters, skateboards and inline skates adds to their convenience but also makes them susceptible to theft.

Various devices have long been utilized in an attempt to prevent the theft of personal property. Theft prevention devices can be of a general nature, such as a combination of a chain, or a braided steel cable, and a lock, or can be of a very specific nature, such as an automobile steering wheel lock. Theft prevention devices are desirable in public places, especially schools, where personal property may be left unattended for substantial periods of time. An example of a general theft prevention device typically provided in schools is an enclosed locker paired with a key-actuated or combination-type lock. A standard locker has the advantage of being able to provide for the relatively safe keeping of a wide range of items; however, it may also be used for the undesirable purpose of storing dangerous objects, weapons or contraband.

Increasingly, concern over personal safety of students has so outweighed concern for protection of personal property that many schools have eliminated the use of enclosed locker facilities entirely. As a result, students are forced to keep their personal belongings with them in order to prevent theft. Thus, students may have to carry their books and other class materials with them throughout the school day. Additionally, the same disadvantages presented by enclosed locker use in public schools apply to their use at shopping centers, beaches, parks and other public places.

SUMMARY OF THE PREFERRED EMBODIMENT

Preferred embodiments of the present securable hanger provide a theft prevention and storage device specifically for folding scooters, skateboards, and other objects, such as motorized scooters, skis and snowboards, for example. Such a hanger also may be utilized to secure other personal belongings, such as backpacks, helmets, protective equipment and the like. Preferred embodiments are capable of separately stowing both a folding scooter and a skateboard without necessitating adjustment of the storage device. This advantageously promotes ease of use, eliminates the need for extraneous adjustment pieces that may be lost or stolen, and allows for efficient utilization of space by conveniently providing generic parking for more than one type of personal transportation vehicle.

One aspect of the present invention thus provides a storage device for supporting either of a scooter and a skateboard. Each of the scooter and the skateboard includes at least a pair of spaced apart wheel assemblies and a deck portion at least partially extending between the wheel assemblies. The storage device includes a first portion defining a mounting surface and a second portion defining a first surface. The first surface is non-removable and non-adjustable with respect to the mounting surface. In addition, at least a portion of the first surface is spaced from the mounting surface. The storage device also includes a third portion defining a second surface, which is spaced from the first surface. The first surface and the second surface define a first space therebetween. The first space is configured to loosely receive the deck portion of the scooter and prevent the wheel assemblies of the scooter from passing therethrough. The first surface and the second surface additionally define a second space therebetween. The second space is configured to loosely receive the deck portion of the skateboard and prevent the wheel assemblies of the skateboard from passing therethrough.

Another aspect of the present invention involves a method of manufacturing a storage device for supporting each of a scooter and a skateboard. Each of the scooter and the skateboard includes at least a pair of spaced apart wheel assemblies and a deck portion at least partially extending between the wheel assemblies. The method includes providing a first work piece and processing the first work piece to form unitary first and second portions. The first portion defines a mounting surface and the second portion defines a non-removable first surface, which is non-adjustable with respect to the mounting surface. At least a portion of the first surface is spaced from the mounting surface. The method also includes providing a second work piece and processing the second work piece to form a third portion, which defines a second surface. The first work piece and the second work piece are connected in such a manner to permit the second surface to be selectively fixed in a closed position of the storage device such that the second surface is spaced from the first surface to define a first space therebetween. Additionally, the first space is configured to loosely receive the deck portion of the scooter and prevent the wheel assemblies of the scooter from passing therethrough. The first surface and the second surface additionally define a second space therebetween. The second space is configured to loosely receive the deck portion of the skateboard and prevent the wheel assemblies of the skateboard from passing therethrough.

A preferred embodiment of the secured hanger assembly does not contain any substantial enclosed area or comers in which larger objects, such as weapons or contraband, can be hidden. Additionally, the hanger may be used to securely store snow skis, or in conjunction with a chain or cable-type lock, to secure inline skates, helmets, protective padding and other items of personal property.

A further aspect of the present invention involves a method of mounting a storage device for securely retaining a pair of snow skis. Each ski has a ski body and a ski boot binding assembly connected to the ski body. The ski defines a fixed length from a rearward edge of the ski body to a leading edge of the binding. The method includes providing a storage device having a first portion, which defines a mounting surface, a second portion, which defines a non-adjustable first surface spaced from, and non-adjustable with respect to the mounting surface, and a third portion, which defines a second surface. The storage device has a closed position wherein the second surface is spaced from the first surface. The first and second surfaces are configured to loosely receive the ski bodies therebetween and prevent the binding assemblies from passing therethrough. The method also includes providing a substantially horizontal base surface and a substantially vertical surface adjacent to the base surface. The storage device is mounted to the vertical surface at a fixed height from the base surface such that the height is greater than the fixed length.

Other features of the present invention include that the preferred embodiments are easily manufactured, may be of a multiple unit assembly, provide durability and require little maintenance. Of course, each of the above-described features and advantages are not necessarily present in every embodiment. That is, some features or advantages may be exemplified in certain embodiments, while other features or advantages are exemplified in other embodiments.

BRIEF DESCRIPTION OF THE DRAWINGS

The above-mentioned and other features of the storage device will now be described with reference to the drawings of preferred embodiments. The illustrated embodiments of the storage device are intended to illustrate, but not to limit the invention. The drawings contain the following figures.

DETAILED DESCRIPTION OF THE INVENTION

Figure 1:
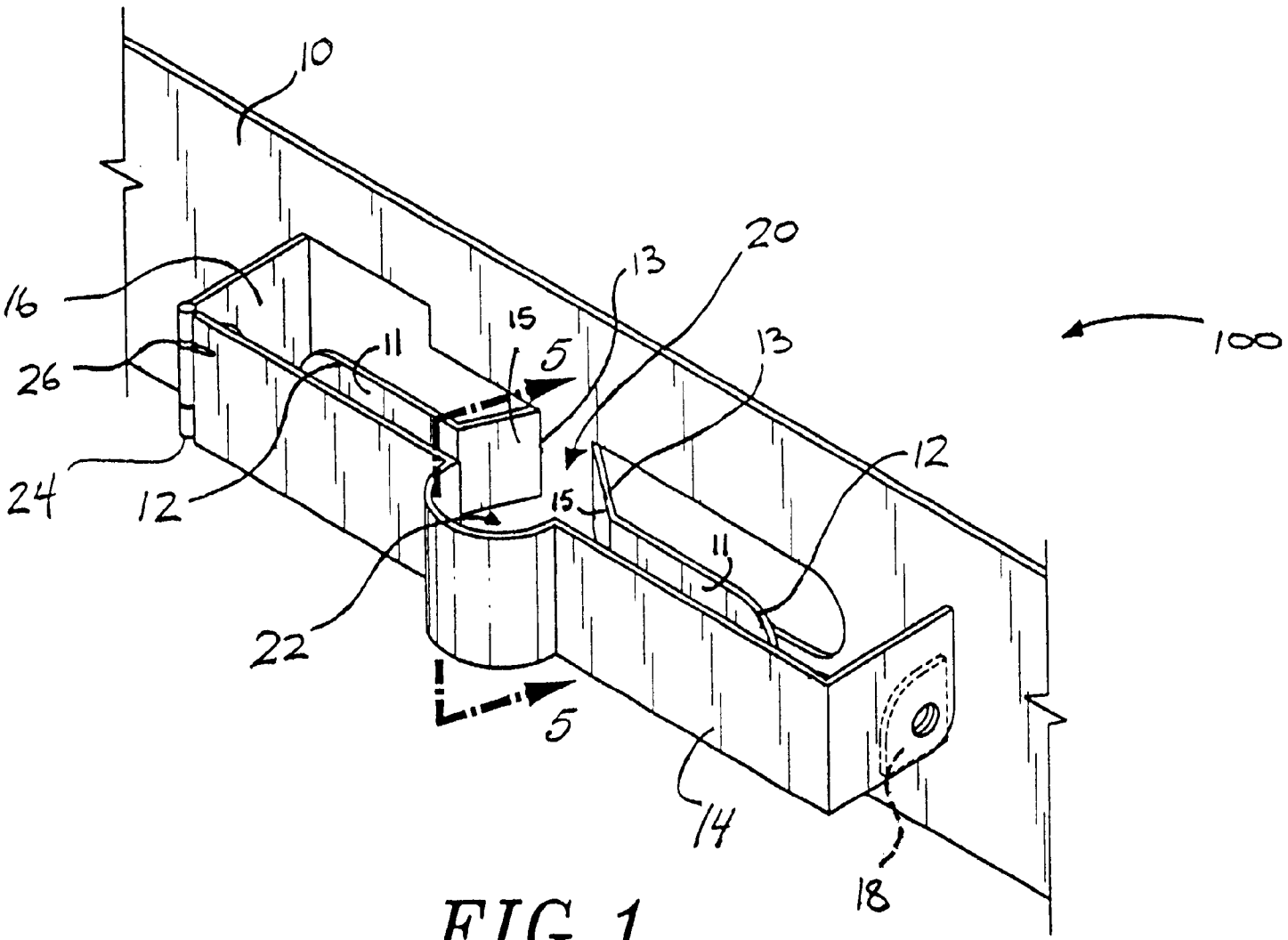
FIG. 1 is a perspective view of a storage device in a closed position.

With reference to FIG. 1, a presently preferred embodiment of a securable hanger 100 is shown. The illustrated hanger 100 generally comprises a mounting plate 10, a locator plate 12 and a gate 14. The hanger 100 is adapted to be securely mounted to a wall or other solid object by any suitable method. For instance lag bolts, machine screws or anti-theft screws may be used to secure the mounting plate 10 to the wall or other object. For instance, the hanger 100 may be mounted to a stationary object, such as a wall or hitching post construction. Alternatively, the hanger 100 may be mounted to a movable object, such as a school bus or other vehicle. The illustrated mounting plate 10 further includes a hinge plate 16 and a tab 18, both extending substantially perpendicularly outward from the mounting plate 10.

The outer surface 11 of the locator plate 12 preferably lies in a plane substantially parallel to a plane defined by the mounting plate 10 and is spaced outwardly therefrom. The illustrated locator plate 12 includes two centrally located angularly disposed members 13 that serve to attach the locator plate 12 to the mounting plate 10. The outer surfaces 15 of the angular members 13 define a cavity 20 in the locator plate 12.

Referring to FIG.'s 1 and 2, the illustrated gate 14 is generally L-shaped, the long leg of which, when in a closed position, lies in a plane substantially parallel to the plane defined by the mounting plate 10. Preferably, at least a portion of the inner surface 32 of the gate 14 is disposed above the upper surface 34 of the locator plate 12. The long leg of the illustrated gate 14 includes a centrally located bend which defines a recess 22. The recess 22 is substantially aligned with the cavity 20 when the gate 14 is in its closed position.

One end of the gate 14 is preferably connected to the forward end of the hinge plate 16 by a hinge shaft 24. The hinge shaft 24 extends through hinge shaft passages formed in the hinge plate 16 and the gate 14 and preferably is adapted to prevent removal of the hinge shaft 24 once assembled. The hinge shaft 24 allows pivotal movement of the gate 14 about a vertical axis. In some arrangements, the hinge location can be rearward of a plane extending through the gate in the closed position. For instance, the hinge can be disposed between the outer surface 11 and the plane of the mounting plate 10.

A biasing member 26 may also be provided that biases the gate 14 to a closed position. In the illustrated arrangement, the biasing member 26 is a torsion spring that engages the hinge plate 16 and the gate 14. This arrangement reduces the likelihood that the gate 14 accidentally remains in an open position when not in use. The short member of the gate 14 is of approximately the same size as the binge plate 16 in the illustrated arrangement. Thus, when the gate 14 is in a closed position, the short member of the gate 14 advantageously contacts the mounting plate 10 and causes the long member of the gate 14 to be approximately parallel with the locator plate 12 and the mounting plate 10. Of course, although the present arrangement utilizes a binge connection, any suitable method for positioning the gate 14 within an appropriate distance from the locator plate 12, and inhibiting its removal, may be used.

The short member of the gate 14 and the tab 18 preferably have complementary apertures 28, 30 of any suitable size and shape. In one arrangement, the aperatures 28, 30 are sized to accommodate a standard padlock when the gate 14 is in a closed position. In another arrangement, the gate 14 and the tab 18 may be permanently or semi-permanently connected to limit the range of motion of the gate when the hanger 100 is unlocked.

The long member of the gate 14 preferably is of a length so that when the gate 14 is in a closed position, the short member of the gate 14 is outside the tab 18 and within sufficient proximity to allow a standard padlock to pass through their respective apertures 28, 30, thus securing the gate 14 in a closed position. This construction provides reinforcement to the smaller tab 18 and reduces the likelihood of damage to the tab 18 when the gate 14 is locked in position.

Figure 2:
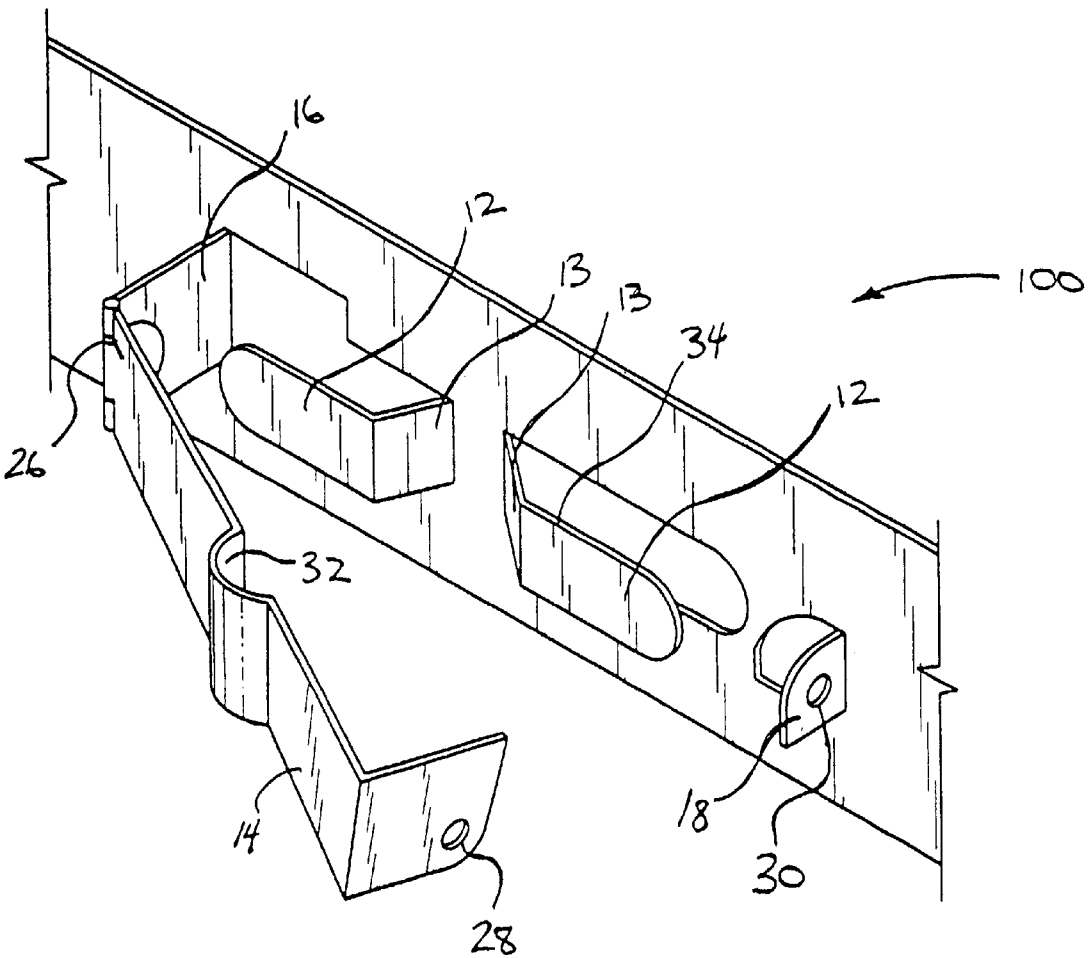
FIG. 2 is a perspective view of the storage device of FIG. 1 in an open position.

With reference to FIG. 2, the securable hanger 100 of the present invention is shown in an open position. It should be noted that the hinge plate 16, the locator plate 12 and the tab 18 preferably are formed from the same work piece that comprises the mounting plate 10 for both manufacturing purposes and aesthetic appeal. However, any one or combination of these components may be formed separately and attached by any suitable method to the mounting plate 10. For instance, by bolting, riveting or welding. Additionally, many of the shapes (i.e., the angled surfaces 13, the round ends of the locator plate 12, etc.) are only one of a variety of suitable shapes. Thus, other shapes will create a different aesthetic appearance.

Figure 3:
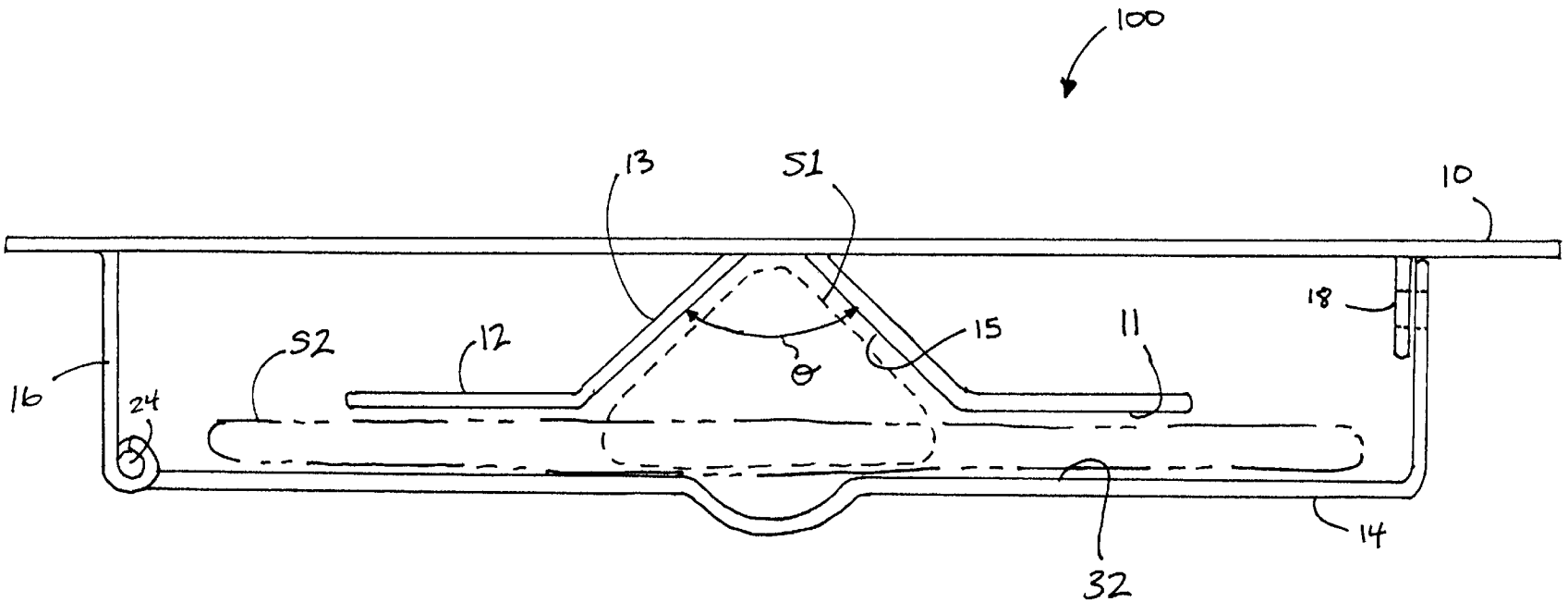
FIG. 3 is a top view of the storage device of FIG. 1.

With reference to FIG. 3, a top view of the hanger 100 illustrates a pair of spaces S1, S2. The space S1 is generally defined between the outer surface 15 of the angular members 13 and the inner surface 32 of the gate 14. The space S1 is generally triangular in shape when viewed from above. The space S2 is generally defined between the outer surface 11 of the locator plate 12 and the inner surface 32 of the gate 14. The space S2 is generally rectangular in shape when viewed from above. The spaces S1 and S2 are configured to loosely receive a scooter and a skateboard, respectively, as will be described below. Loosely receiving the vehicles allows variously sized and shaped vehicles to be securely accommodated without requiring adjustability.

Advantageously, a preferred embodiment of the hanger 100 constructed in accordance with certain features, aspects and advantages of the present invention provides secured storage for a multitude of objects, including folding scooters and skateboards, without the disadvantage of providing concealed areas in which to hide dangerous objects, weapons or contraband. This feature of the preferred embodiments is advantageous when the hanger is used in schools, shopping centers, parks and other public places; where hidden, dangerous objects may pose a threat to the safety of many persons.

Figure 4:
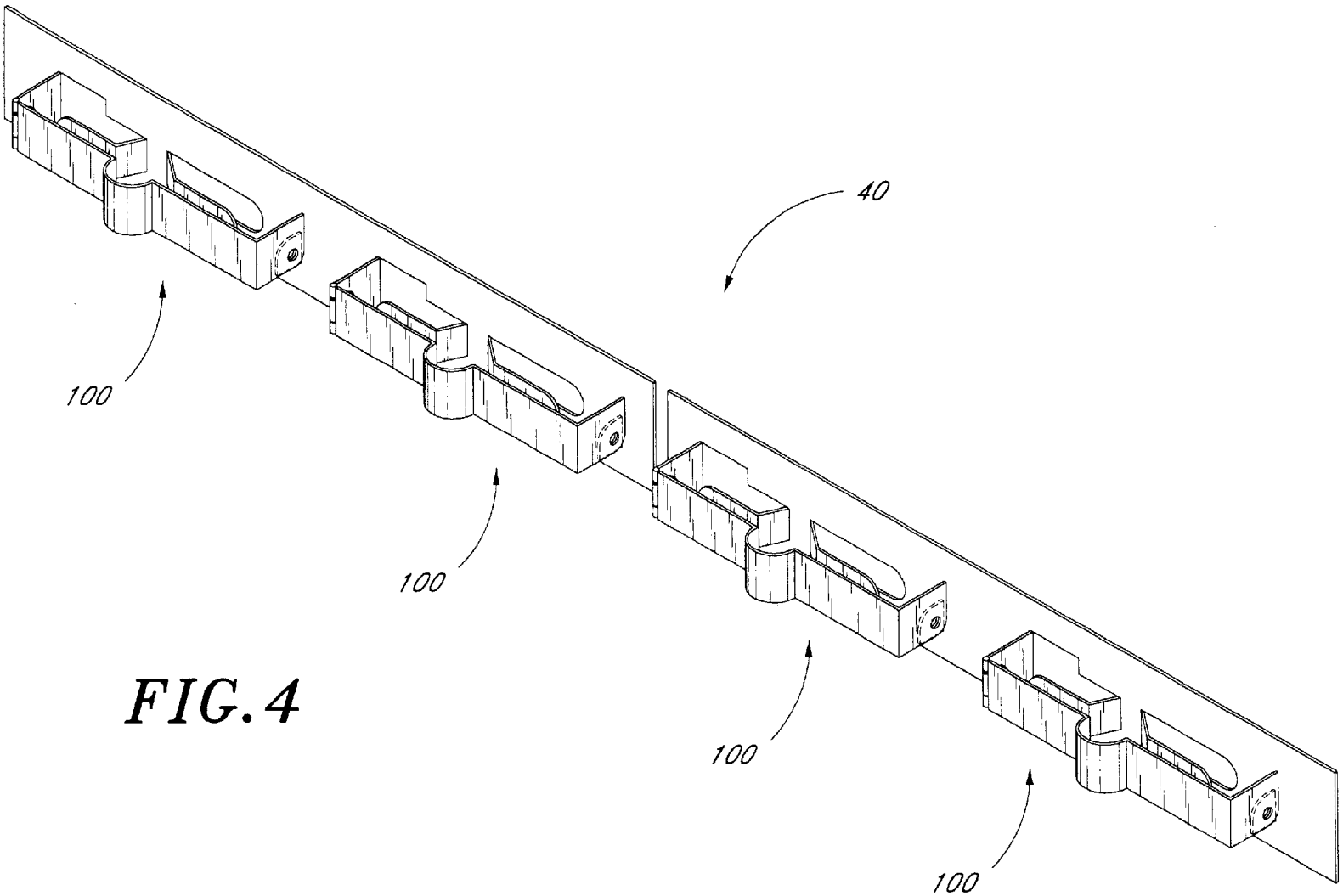
FIG. 4 is a perspective view of a pair of multiple storage devices, each including two holders, as mounted for use.

FIG. 4 depicts a pair of exemplary commercial embodiments, each having two securable hangers 100 mounted for use on a wall 40. The two hangers 100 of each commercial unit are constructed from a single mounting plate 10. The number of securable hangers produced from a single work piece and provided on a common mounting plate 10 can be varied from the singular, for use in the home, up to any reasonable number that would be feasible for a given mounting structure.

Figure 5:
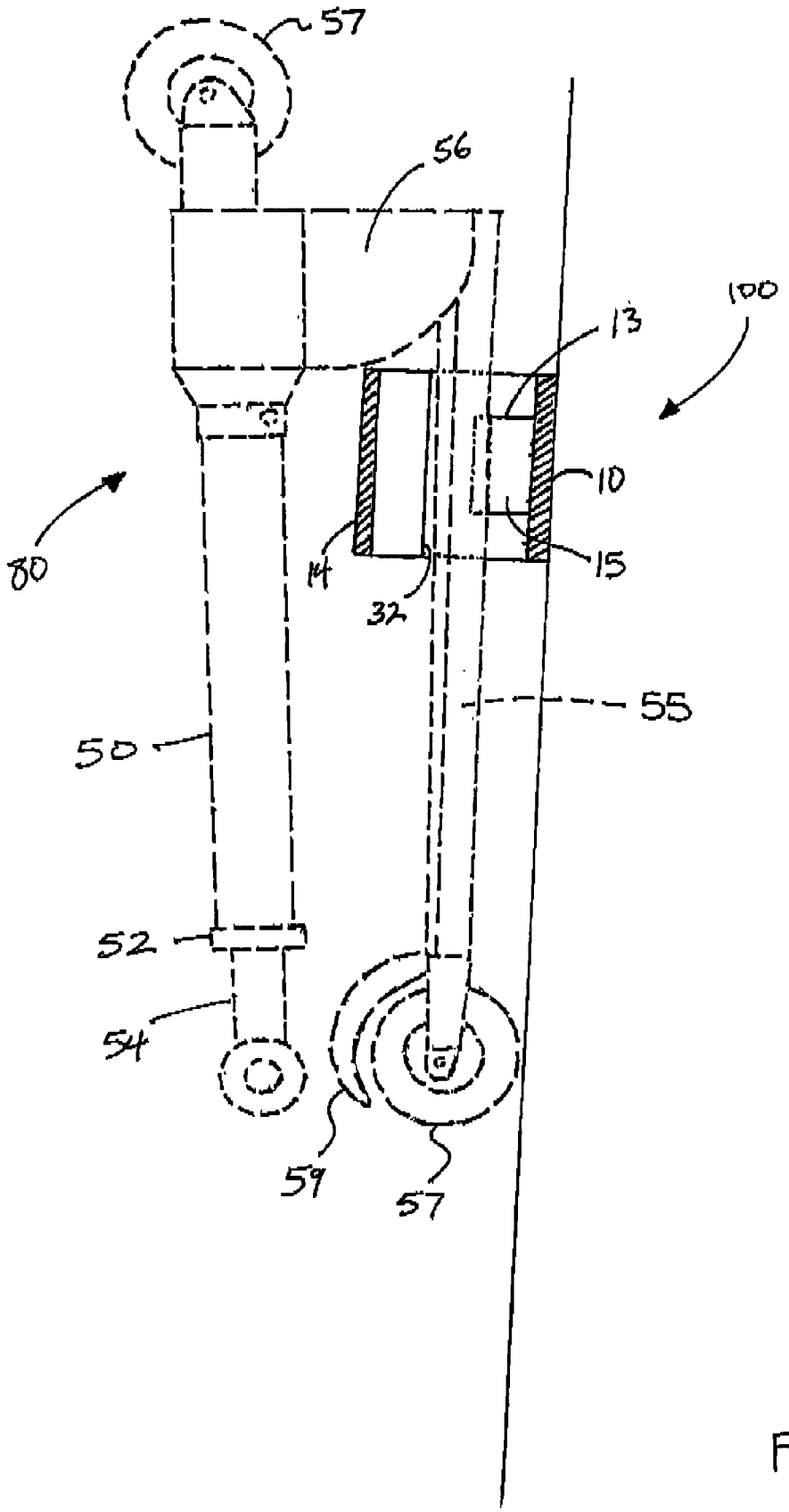
FIG. 5 is a cross-sectional view of the storage device of FIG. 1 securely storing a folding scooter, which is illustrated in phantom.

The securable hanger 100 of the present invention is shown securely storing a folding scooter 80 in FIG. 5. A typical folding scooter 80 has two inline skate-type wheel assemblies 57 on either end of a body section, or deck, 55. The user stands upon the upper surface of the body section 55 of the scooter 80 and utilizes a two-piece, T-shaped handle that projects upwardly from the front end of the body for steering. The body and the handle are joined with a bracket 56 that allows the handle to be folded toward the body and locks the scooter 80 in a compact storage mode. Additionally, the top portion 54 of the two-piece handle is capable of retracting inside the bottom portion 50 and is held in its desired position at their junction by a quick-release handle clamp 52. This allows for adjustment in the height of the handle to accommodate users of different size and for the complete retraction of the top portion 54 of the handle into the bottom portion 50 for the compact storage mode.

When in the compact storage mode, as depicted in FIG. 5, the deck 55 of the scooter 80 can be placed in the securable hanger 100 between the inner surface 32 of the gate 14 and the outer surfaces 15 of the angular members 13. In this manner, the scooter deck 55 can be secured within the cavity 20 and recess 22, or the space S1. When the gate 14 is closed, the scooter 80 can be lowered such that it hangs from the top surface 34 of the locator plate 12, by its own weight, on bracket 56. FIG. 5 illustrates one example of how a scooter 80 may be secured by the hanger 100. However, other suitable arrangements for storing the scooter may also be utilized.

The space S1 is advantageously sized to allow clearance between the scooter deck 55 and the surfaces 15 and 32 in order to prevent damage to the scooter 80 from undesired clamping pressure. Desirably, the space S1 has a depth between 1.75 and 2.0 inches. Preferably the depth of the space S1 is between 1.9 and 2.0 inches and more preferably is approximately 2.0 inches. Desirably, the angle $\theta$ is between 80 and 100 degrees. Preferably the angle $\theta$ is between 85 and 95 degrees and more preferably is approximately 90 degrees.

When the gate 14 is secured to the mounting plate 10, such as with a padlock inserted through the complimentary apertures 28 and 30, the scooter 80 is secured from being removed in an upward or downward direction due to the prohibitive size of the bracket 56 and wheel assembly 57 in comparison to the space S1. Advantageously, this allows for secure retention of the scooter 80, without necessitating undesirable clamping pressure. A motorized scooter may be securely stowed in a similar manner.

Figure 6:
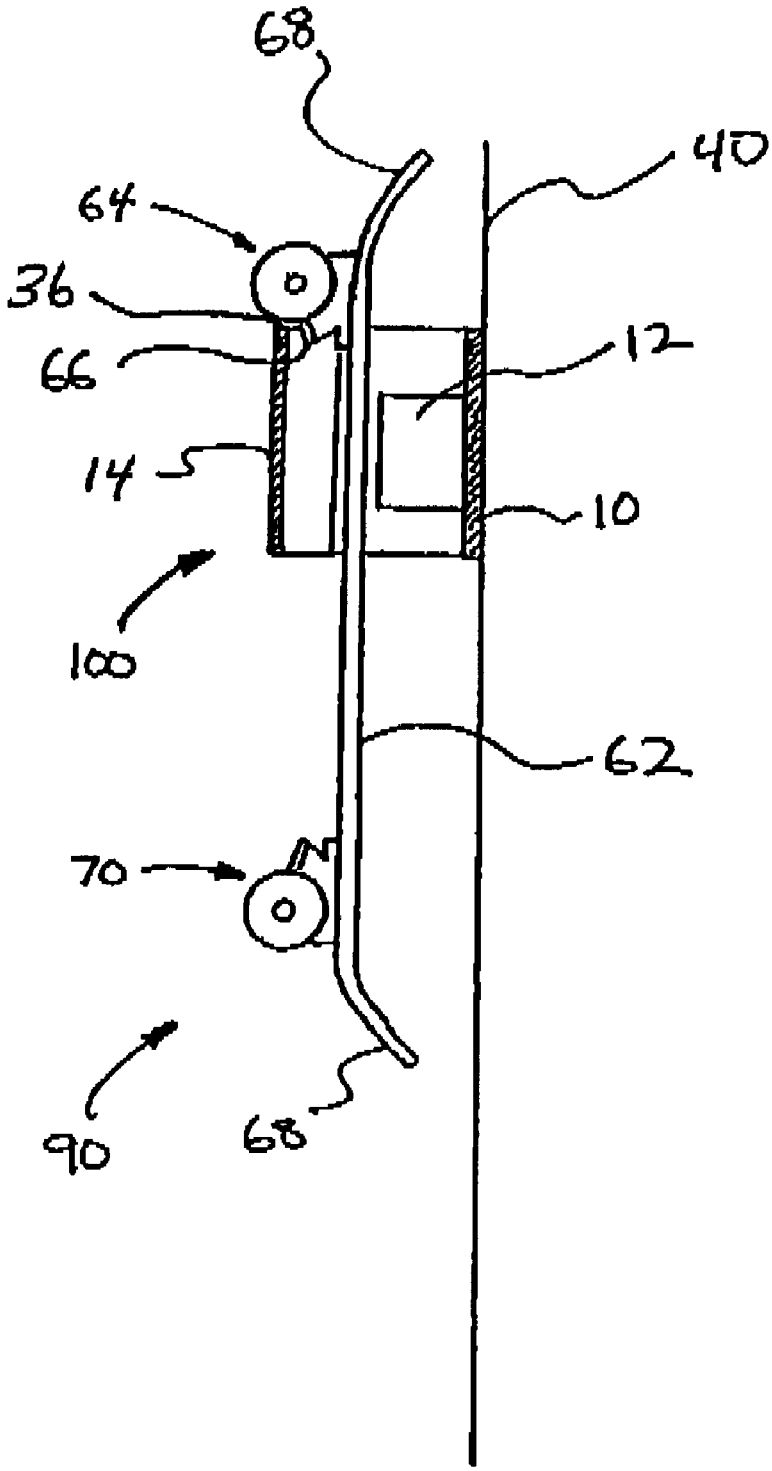
FIG. 6 is a cross-sectional view of the storage device of FIG. 1 securely storing a skateboard.

FIG. 6 shows the securable hanger 100 used to securely store a skateboard 90. With the gate 14 in its open position, the skateboard 90 is placed between the gate 14 and locator plate 12, or space S2, with the top riding surface 62 of the board facing the locator plate 12. The locator plate 12 preferably is spaced forwardly from the mounting plate 10 a sufficient distance to accommodate the curved tail section 68 of a standard skateboard 90. Desirably, the locator plate 12 is spaced between 1.0 and 1.125 inches from the mounting plate 10. Preferably the locator plate 12 is spaced between 1.065 and 1.125 inches and more preferably is spaced approximately 1.75 inches from the mounting plate 10.

The enclosed space S2 between the inner surface 32 of the gate 14 and the outer surface 11 of the locator plate 12 advantageously is sufficient to accommodate a typical skateboard 90 without exerting clamping pressure upon it, thereby preserving the structural integrity and the outward appearance of the board 90. Desirably, the distance between the surface 11 and the surface 32 is between 0.50 and 1.00 inches. Preferably the distance between the surface 11 and the surface 32 is between 0.625 and 0.75 inches and more preferably is approximately 0.75 inches.

When the gate 14 is closed and secured to the mounting plate 10, the skateboard 90 preferably lowers and rests with its upper wheel and axle assembly, or truck 64, positioned on the upper surface 36 of the gate 14. The recess 22 of the illustrated gate 14 advantageously provides clearance for the protruding portion 66 of the upper skateboard truck 64. The skateboard 90 is secured in position within the locked hanger 100 by the upper and lower trucks 64, 70. Additionally, the hanger 100 may securely stow a snowboard, in a manner similar to the securing of a skateboard 90, as described above.

Figure 7:
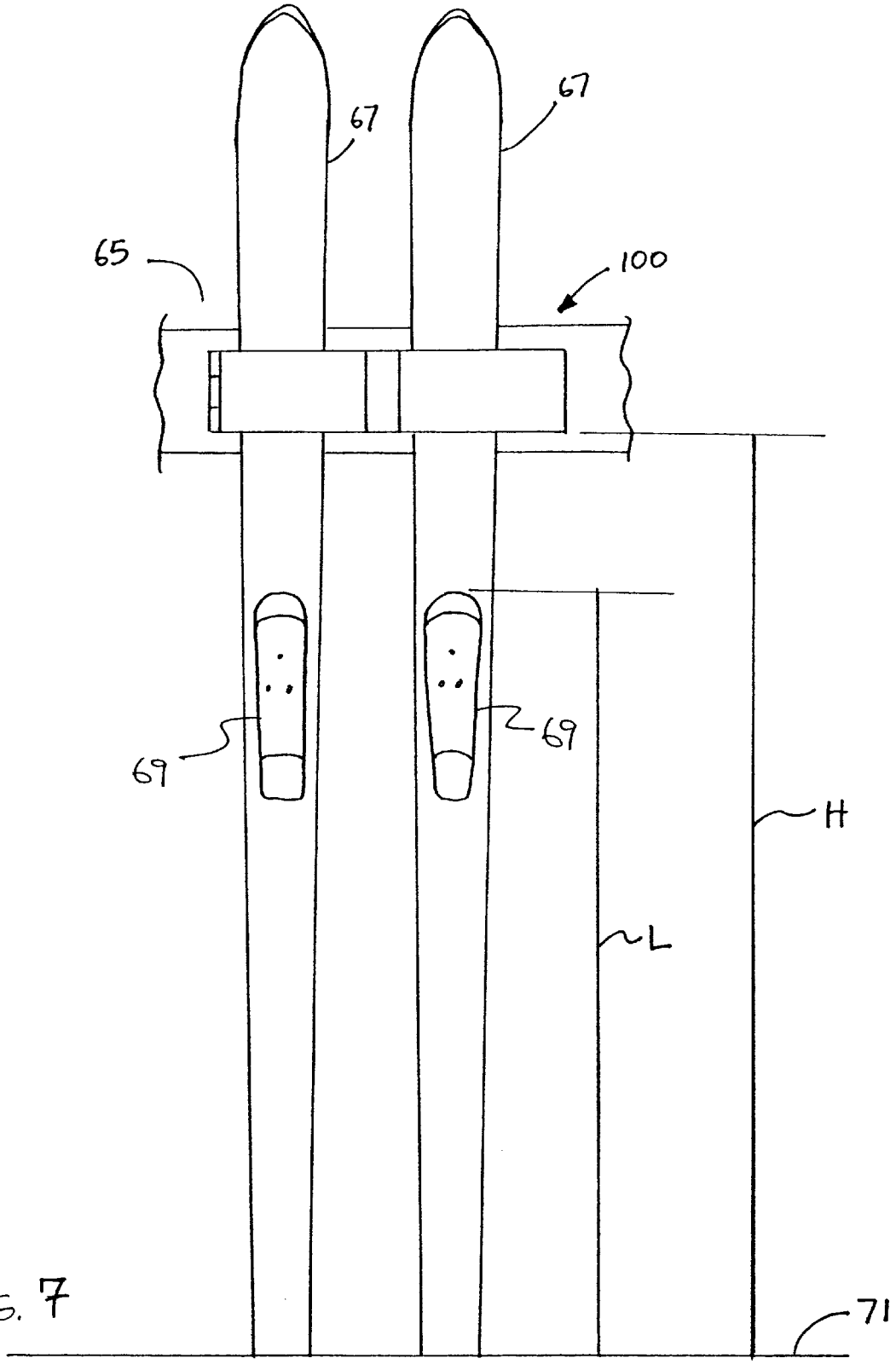
FIG. 7 is a front view of the storage device of FIG. 1 mounted for securely storing a pair of snow skis.

With reference to FIG. 7, the securable hanger 100 may also be used to securely store a pair of snow skis 67. The hanger 100 is mounted to a vertical surface, such as a wall 65, at a height H. The height H is preferably greater than a length L of the rear edge of the ski 67 to the leading edge of the binding 69. The skis 67 may be positioned in the space S2 between the locator plate 12 and the gate 14 in a manner similar to the secured storage of a standard skateboard (FIG. 6). The skis 67 so mounted are inhibited from being moved in a downward direction by the floor or the ground 71, and inhibited from being moved in an upward direction by the ski bindings 69.

Figure 8:
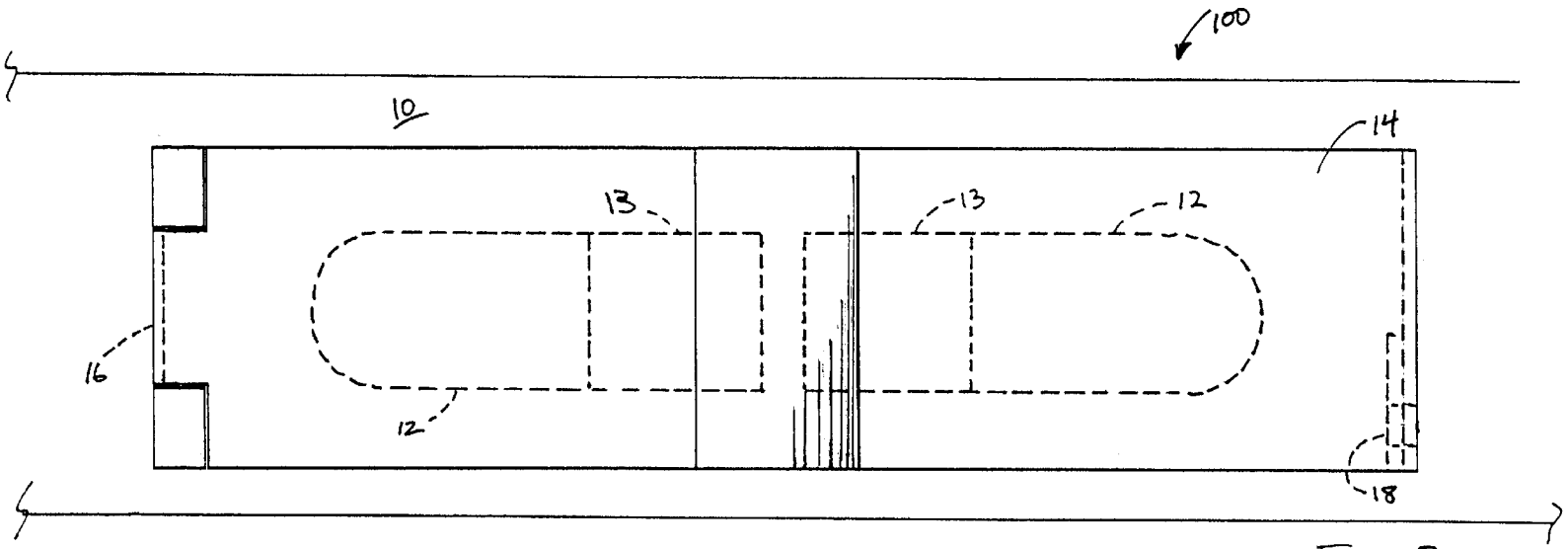
FIG. 8 is a front view of the storage device of FIG. 1.
Figure 10:
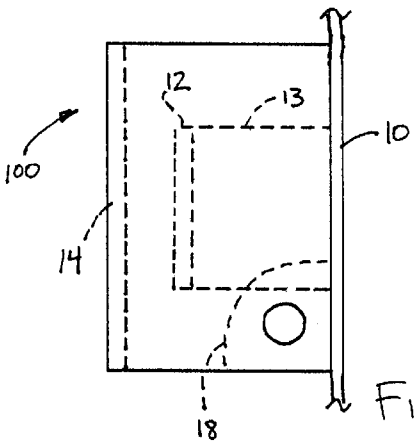
FIG. 10 is a right side view of the storage device of FIG. 1.
Figure 9:
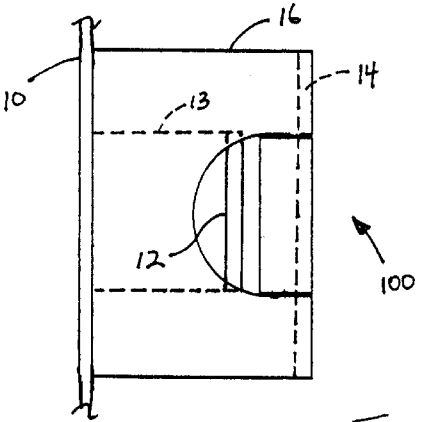
FIG. 9 is a left side view of the storage device of FIG. 1.
Figure 11:
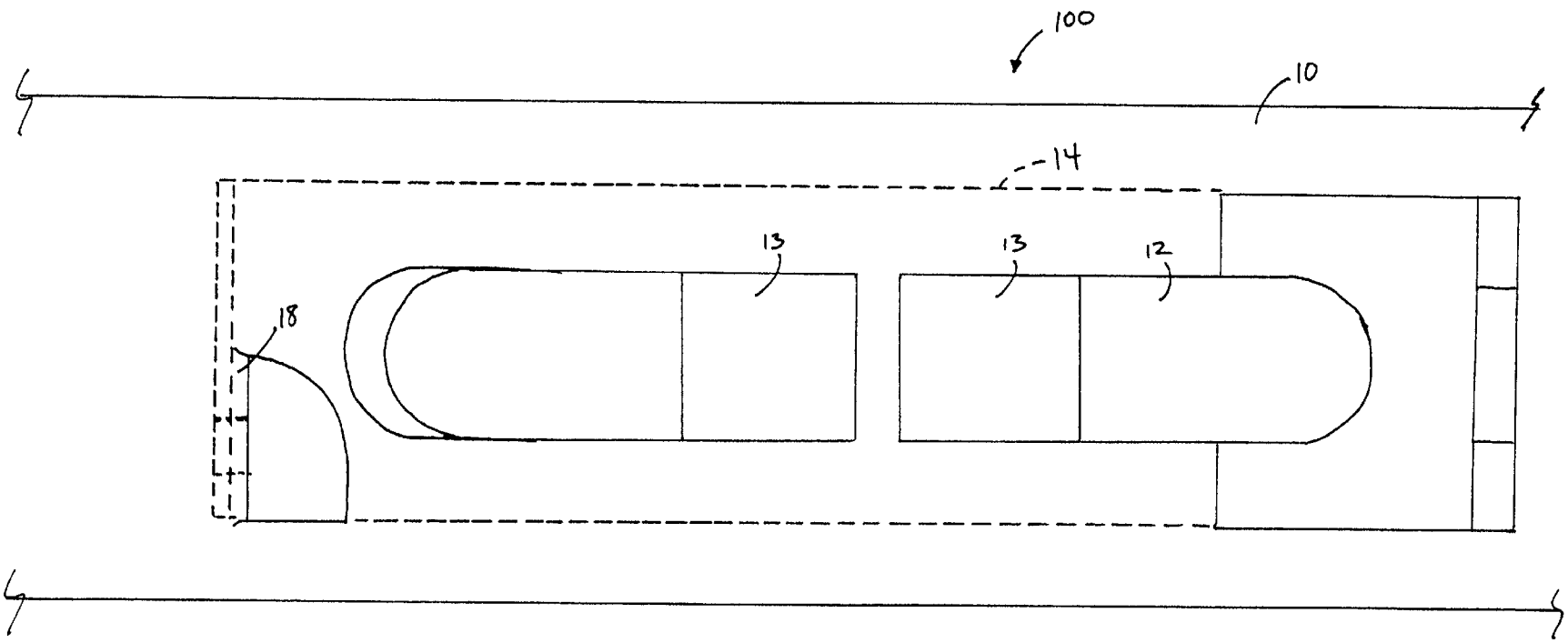
FIG. 11 is a rear view of the storage device FIG. 1.
Figure 12:
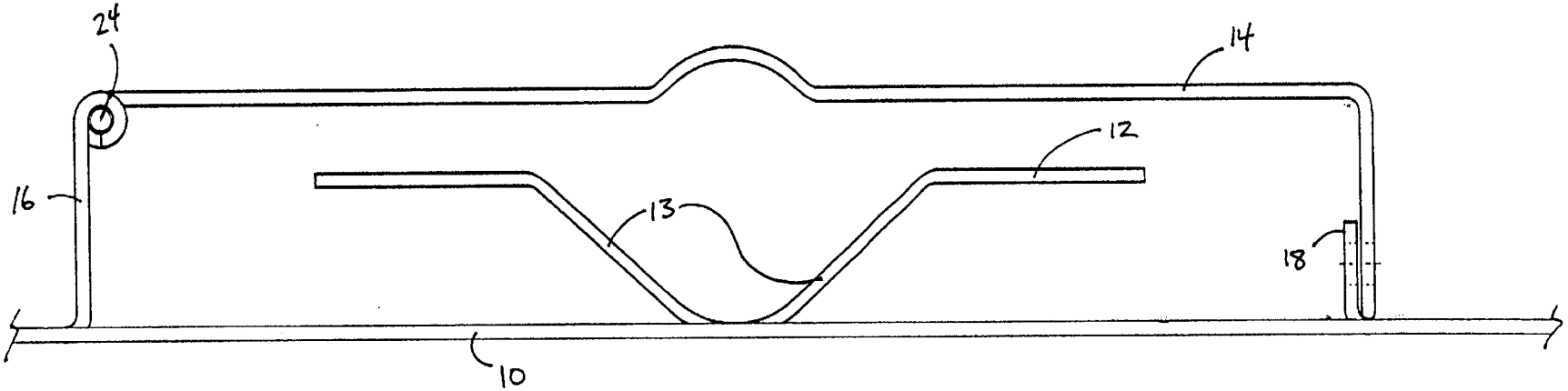
FIG. 12 is a bottom view of the storage device of FIG. 1.

FIG. 8 is a front plan view of the hanger 100 in a closed position. FIG. 9 is a left side plan view and FIG. 10 is a right side plan view of the hanger 100. FIG. 11 is a rear view of the hanger 100. FIG. 12 is a bottom plan view of the hanger 100.

The securable hanger 100 also can advantageously be used as a storage device for a backpack (not shown). With the gate in an open position, each strap of the backpack may be placed over opposite ends of the locator plate 12. The resistance of the biasing member 26 will then close the gate 14, thereby assisting in holding the backpack in place. This feature allows the illustrated embodiment of the present invention to provide a safe alternative to enclosed locker use, especially in schools.

The securable hanger 100 may be used to secure any number of articles that may slide over the gate 14 or be positioned securely between the gate 14 and locator plate 12. For example, elbow or knee pads may be slid onto the gate 14 through their openings or roller skates may be secured in a similar manner to a skateboard, as described above. Additionally, in its closed and secured position, the securable hanger may be utilized in a similar manner as a conventional bicycle rack. Moreover, a cable or chain-type lock may be used to secure a number of items to the hanger, such as inline skates, helmets, protective padding and the like.

Preferably, the securable hanger is made from a common variety of steel and then zinc-plated, both for increased durability and ease of maintenance. However, the present invention could also be produced from any type of solid material, such as steel, aluminum, plastic or wood. Additionally, any number of finishing materials could be utilized, such as painting, powder coating, anodizing or other varieties of plating. In some arrangements, plastic materials, foam materials or other surface coatings can be placed over the surfaces that will contact the stowed vehicle to reduce the likelihood of scratching, scuffing or marring the finish of the vehicle.

Preferably, the present hanger 100 is manufactured by stamping, a combination of laser cutting and stamping, or other suitable methods. Additionally, the securable hanger can be mounted to the desired wall or other suitable structure utilizing any suitable anti-theft attachment method, such as using MCGUARD brand one-way fasteners, for instance.

Although this invention has been described in terms of certain preferred embodiments, other embodiments that are apparent to those of ordinary skill in the art are also within the scope of this invention. For example, the components of the invention may be of alternative shape or form while nonetheless serving the intended function, and are considered part of this invention. Accordingly, the scope of the invention is intended to be defined by the claims that follow.

We claim:

1. A storage device for supporting each of a scooter and a skateboard, each of said scooter and said skateboard comprising at least a pair of spaced apart wheel assemblies and a deck portion at least partially extending between said wheel assemblies, each of said deck portions of said scooter and said skateboard having a foot support surface, said storage device comprising:

a first portion defining a mounting surface;

a second portion defining a first surface being non-removable and non-adjustable with respect to said mounting surface, at least a portion of said first surface being spaced from said mounting surface;

a third portion defining a second surface spaced from said first surface, said first surface and said second surface being substantially parallel to one another; and wherein said first surface and said second surface define a first space therebetween, said first space being configured to non-frictionally receive said deck portion of said scooter, such that said foot support surface is substantially parallel to said first and second surfaces, and prevent said wheel assemblies of said scooter from passing therethrough, said first surface and said second surface additionally defining a second space therebetween, said second space being configured to non-frictionally receive said deck portion of said skateboard, such that said foot support surface is substantially parallel to said first and second surfaces, and prevent said wheel assemblies of said skateboard from passing therethrough.

2. The storage device of claim 1, wherein said first space and said second space are at least partially coextensive.

3. The storage device of claim 1, wherein said first portion and said second portion form a unitary structure.

4. The storage device of claim 1, wherein said third portion is configured to be securable in a fixed position with respect to said first portion.

5. The storage device of claim 4, wherein said third portion is pivotally connected to said first portion for movement between an open position and a closed position.

6. The storage device of claim 5, wherein said first portion additionally comprises a tab having an aperture therethrough, said third portion also including an aperture, said apertures being configured to align with each other when said third portion is in said closed position, said apertures being configured to receive a padlock for securing said third portion in said closed position.

7. The storage device of claim 6, wherein said tab is unitarily formed with said first portion.

8. The storage device of claim 1, wherein said second portion defines an upper surface and a lower surface, said upper surface being spaced from said lower surface thereby defining a vertical height of said first space, said vertical height being configured to support said scooter in a substantially vertical orientation.

9. The storage device of claim 1, wherein the first, second and third portions define a generally C-shaped horizontal cross section.

* * * * *